US005259619A

United States Patent [19]

Rosewarne

[11] Patent Number: 5,259,619

[45] Date of Patent: Nov. 9, 1993

[54] MAZE

[76] Inventor: Fenton Rosewarne, 1191 H Chess Dr., Foster City, Calif. 94404

[21] Appl. No.: 830,383

[22] Filed: Feb. 3, 1992

[51] Int. Cl.[5] ..... A63F 9/08

[52] U.S. Cl. ..... 273/153 R; 273/156

[58] Field of Search ..... 273/153 R, 153 S, 155, 273/156; 70/289, 290

[56] References Cited

U.S. PATENT DOCUMENTS

| | | | |
|---|---|---|---|
| 3,819,187 | 6/1974 | Downs | 273/156 |
| 3,824,815 | 7/1974 | Darling | 273/156 |
| 4,065,132 | 12/1977 | Giakas | 273/153 R |
| 4,357,016 | 11/1982 | Allison | 273/156 |
| 4,805,910 | 2/1989 | Monticolombi et al. | 273/153 R |
| 4,974,848 | 12/1990 | Gieseker | 273/153 R |

*Primary Examiner*—V. Millin
*Assistant Examiner*—Steven B. Wong
*Attorney, Agent, or Firm*—Wagner & Middlebrook

[57] ABSTRACT

A manually operated maze puzzle including a hollow body having a recess lined with a maze pattern on a cylindrical inner surface. An operator which matches the shape of the recess includes a maze follower such as a pin. The maze is totally concealed. It includes a starting groove at an innermost position with maximum nesting of the operator within the body. A plurality of incorrect channel paths are included extending toward the mouth of the recess. One correct path is included. All incorrect exit paths include one way traps that require a return to the original start path. Matching indicia indicate a correct solution.

13 Claims, 6 Drawing Sheets

Fig 6
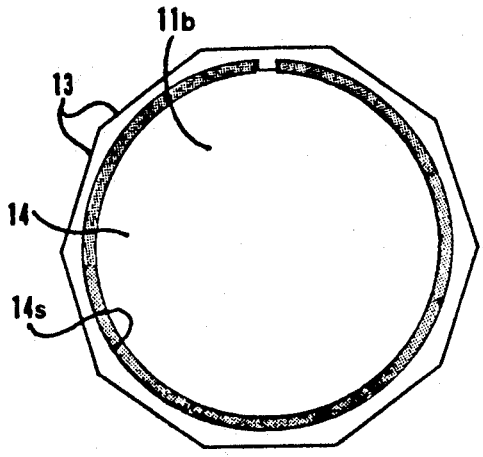
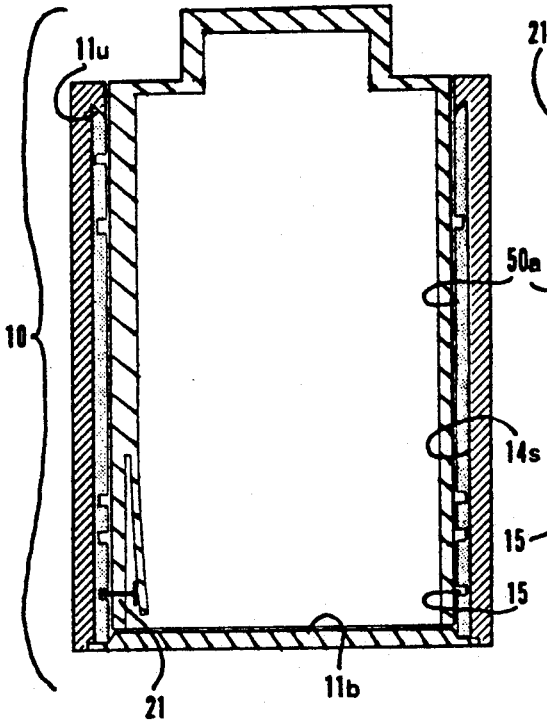
Fig 4
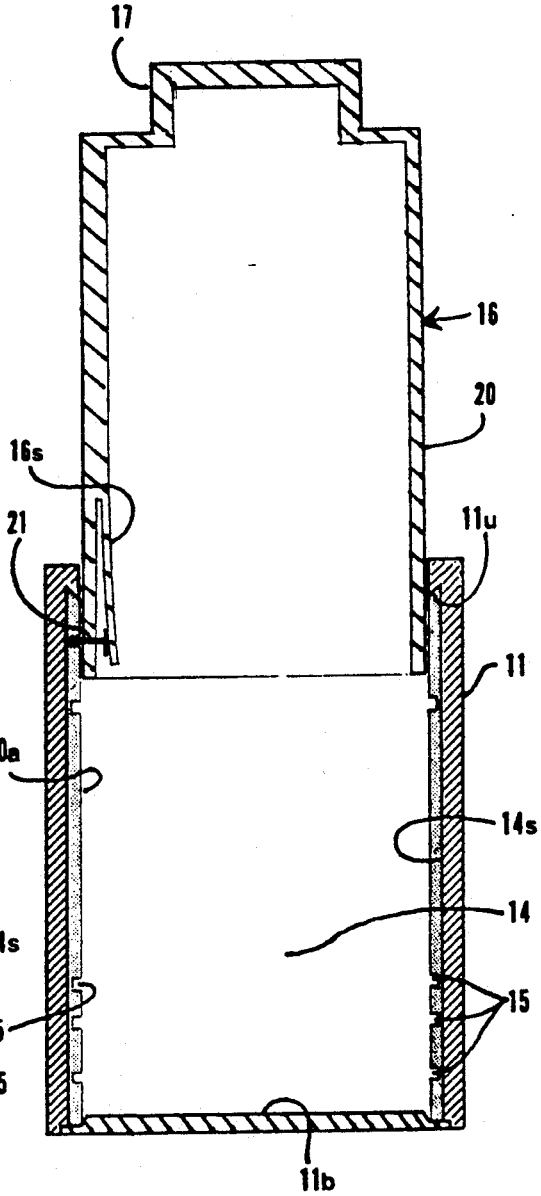
Fig 5

Four way intersection

T-Intersection or 3 Way

One way trap

MAZE

BACKGROUND OF THE INVENTION

The maze has intrigued man for centuries. Maze puzzles have been found in ancient tombs. Landscape mazes delighted seventeenth to nineteenth century gentry. In more recent times, probably the most popular maze puzzle ever invented, Rubic's Cube captured the imagination of millions of people worldwide. The Rubic Cube produced a generation of dexterous competitive enthusiasts who could fascinate observers who were unable to even solve the puzzle let alone do it in a few seconds. The interest in Rubic's Cube generated renewed interest in maze type puzzles as it represented by the following patents:

| PATENT NO. | INVENTOR | PATENT DATE |
|---|---|---|
| 3,819,187 | G. W. Downs | June 25, 1974 |
| 4,805,910 | Monticolombi et al | Feb. 21, 1989 |
| 4,861,036 | T. Watanabe | Aug. 29, 1989 |
| 4,822,049 | T. Biber | Apr. 18, 1989 |
| 4,674,753 | R. Hochstim | June 23, 1987 |
| 4,674,749 | Shaffer et al | June 23, 1987 |
| 4,667,960 | G. Stefanini | May 26, 1987 |
| 2,714,511 | D. J. Derrig | Aug. 2, 1955 |

Each of these newer mazes offer different features.

BRIEF DESCRIPTION OF THE INVENTION

I have carefully analyzed maze puzzles and, to my amazement, I found that none seemed to provide the combination of:

1. concealed maze requiring decisions to be made tactically without visual aid;
2. variable difficulty as the player progresses, particularly increasing difficulty as the solution progresses;
3. a colorful maze with both visual and tactical indications of success for amusement of both sighted and unsighted players;
4. an error in solving the maze redirects the player to the beginning;
5. the maze itself is totally concealed at all times; and
6. pyramided mazes to be solved in sequence and of different degrees of difficulty.

These features are all achieved in a maze puzzle comprising a hollow body with a cylindrical internal wall and indicators such as colored markings on the outer wall. The inner wall of the hollow body contains a recessed maze track having the following characteristics:

a) a bottom track as a starting point;
b) a plurality of intersections between lateral and longitudinally extending track sections;
c) one or more one-way traps;
d) one or more T-intersections;
e) one or more cross-intersections;
f) one outermost correct track section; and
g) a return to the start track as the only exit from all other (incorrect) outermost tracks.

Engaging the maze is a pin or track follower located on the outer surface of the operator which is preferably a nesting cylinder. The nesting cylinder includes on its outer surface visual and tactual symbols such as colors which correspond to symbols on the body. The symbols on the internal symbol are preferably concealed until the outermost track is engaged by the track follower so that success or failure is concealed until the final move.

In an alternative embodiment, a plurality of cylinders are nested for sequential solution. Succeeding cylinders preferably provide mazes of increasing difficulty.

BRIEF DESCRIPTION OF THE DRAWING

This invention may be more clearly understood from the following detailed description and by reference to the drawing in which:

FIG. 4 is a diametrical sectional view of the embodiment of FIGS. 1-3 taken through the maze in its nested condition;

FIG. 5 is a diametrical sectional view similar to FIG. 4 when the maze in its outermost position;

FIG. 6 is a top view of the body member of this invention;

DETAILED DESCRIPTION OF THE INVENTION

Referring now to FIGS. 1-6, a maze type puzzle, generally designated 10, may be seen as including a body 11 having an external surface having discrete indicia such as colored stripes 12 located around the side walls of the body 11. In the preferred embodiment shown in FIGS. 1-6, the stripes 12 are located on facets 13 although they may be printed or otherwise placed on a cylindrical outer surface. Ideally, the indicia have tactually identifiable shapes as well to allow this maze puzzle to be played by unsighted persons.

Figure 3:
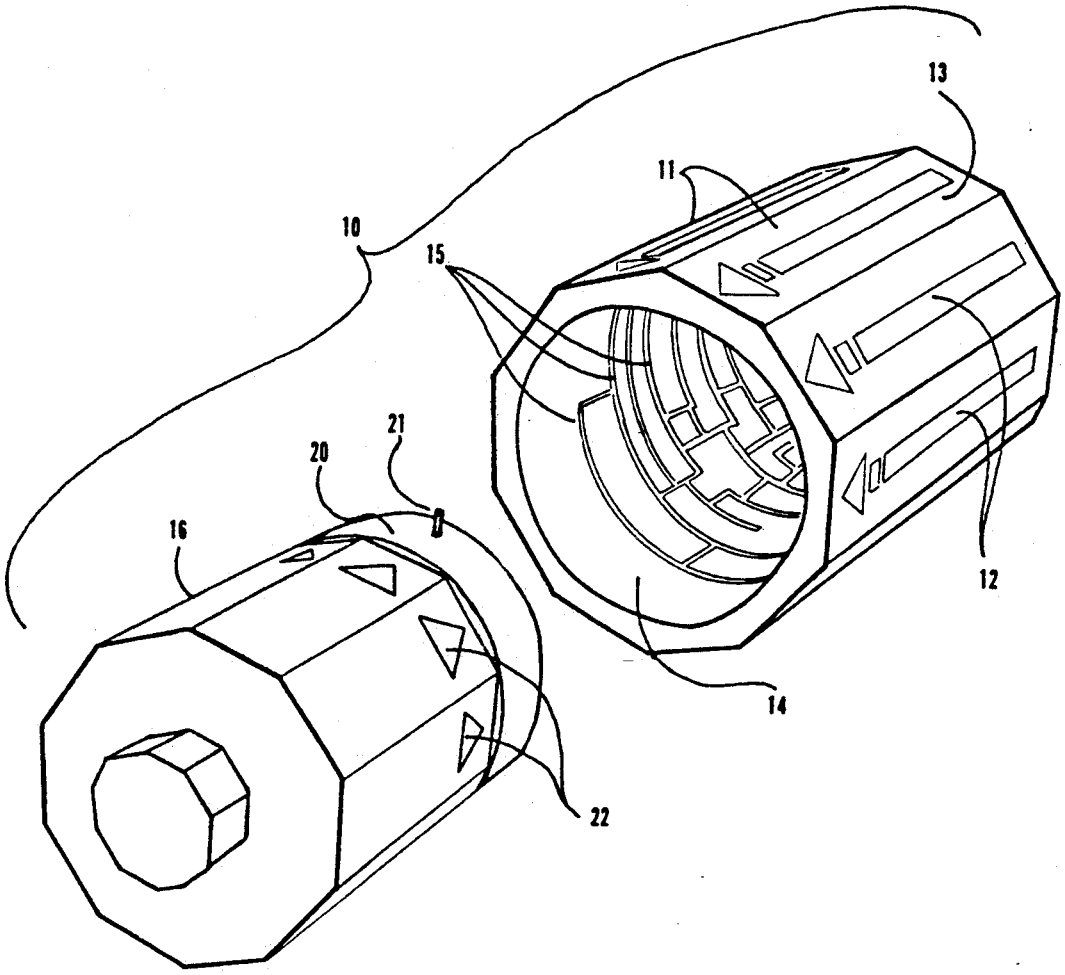
FIG. 3 is an exploded view of the maze of FIGS. 1 and 2.

The body 11 has a recess 14 at one end as seen in FIGS. 3-5 defined by bottom wall 11*b*, seen in the drawing FIG. 4 and a cylindrical side wall 14*s*. A maze pattern in the form of an array of interconnected grooves 15 constituting continuously connected maze tracks line the recess wall. The maze pattern within the recess 14 is concealed at all times.

Engaging the body 11 and normally stored largely within the recess 14, as illustrated in FIG. 4, is a mating operator 16 which is dimensioned for close fit within the recess 14 with a handle portion 17 extending out of the recess 14 to allow the user to manipulate the operator 16 when attempting to solve the maze puzzle. The operator 16 includes a cylindrical surface 20 which closely conforms to the inner wall of the recess 14 to be in slip fit therewith.

Figure 1:
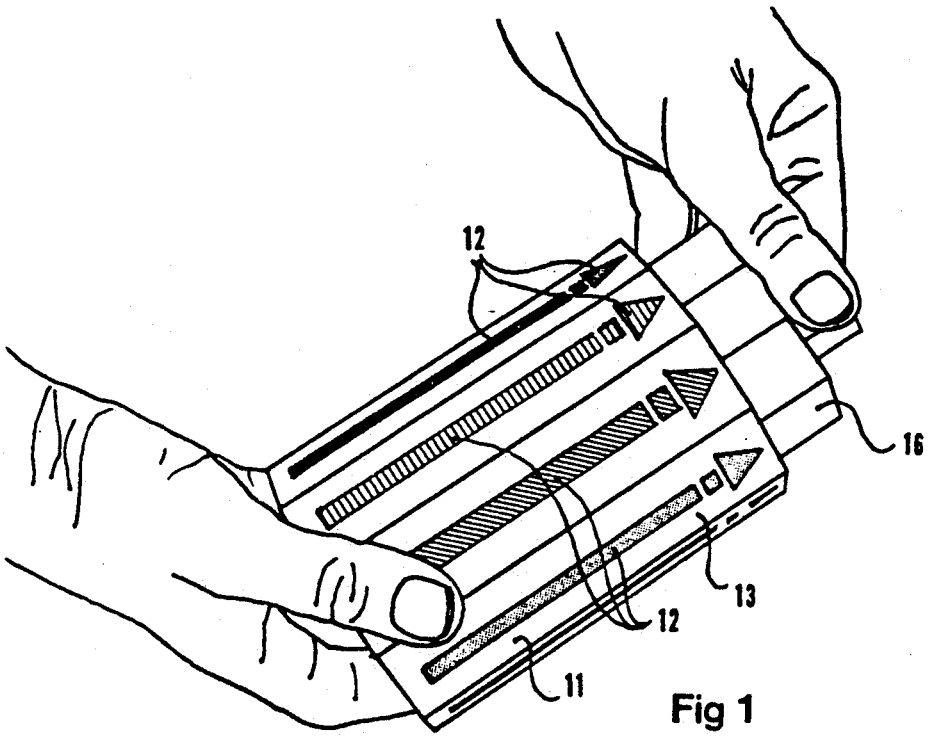
FIG. 1 is a perspective view of a maze of this invention ready for commencing solution.
Figure 2:
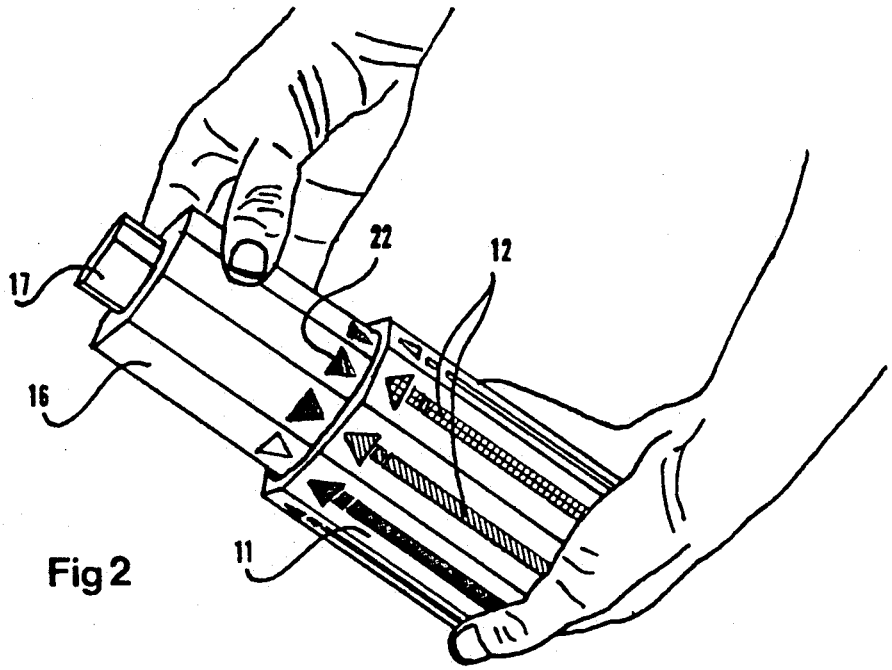
FIG. 2 is a perspective view of the maze of FIG. 1 incorrectly solved.

A spring loaded pin 21, seen in FIGS. 4 and 5, extends out of the cylindrical outer wall 20 of the operator 16. When assembled as shown in FIGS. 1 and 2, the outer end of pin 21 engages the groove 15 and controls the relative movement of the operator 16 with respect to the body 11 in both rotational and axial directions. The pin 21 is spring biased outward by spring means such as integral spring 16*s* of FIG. 5.

Whenever the operator 16 is in its outermost position as illustrated in FIG. 2, a second set of indicia 22 is exposed allowing the comparison with the indicia 12 on the body 11. If the two sets of indicia 12 and 22 match exactly, the player has successfully solved the maze. If they do not match, the maze puzzle has not been solved successfully and the only movement of the operator 16 available in the axial direction is to return directly to the beginning (nested) position.

Figure 7:
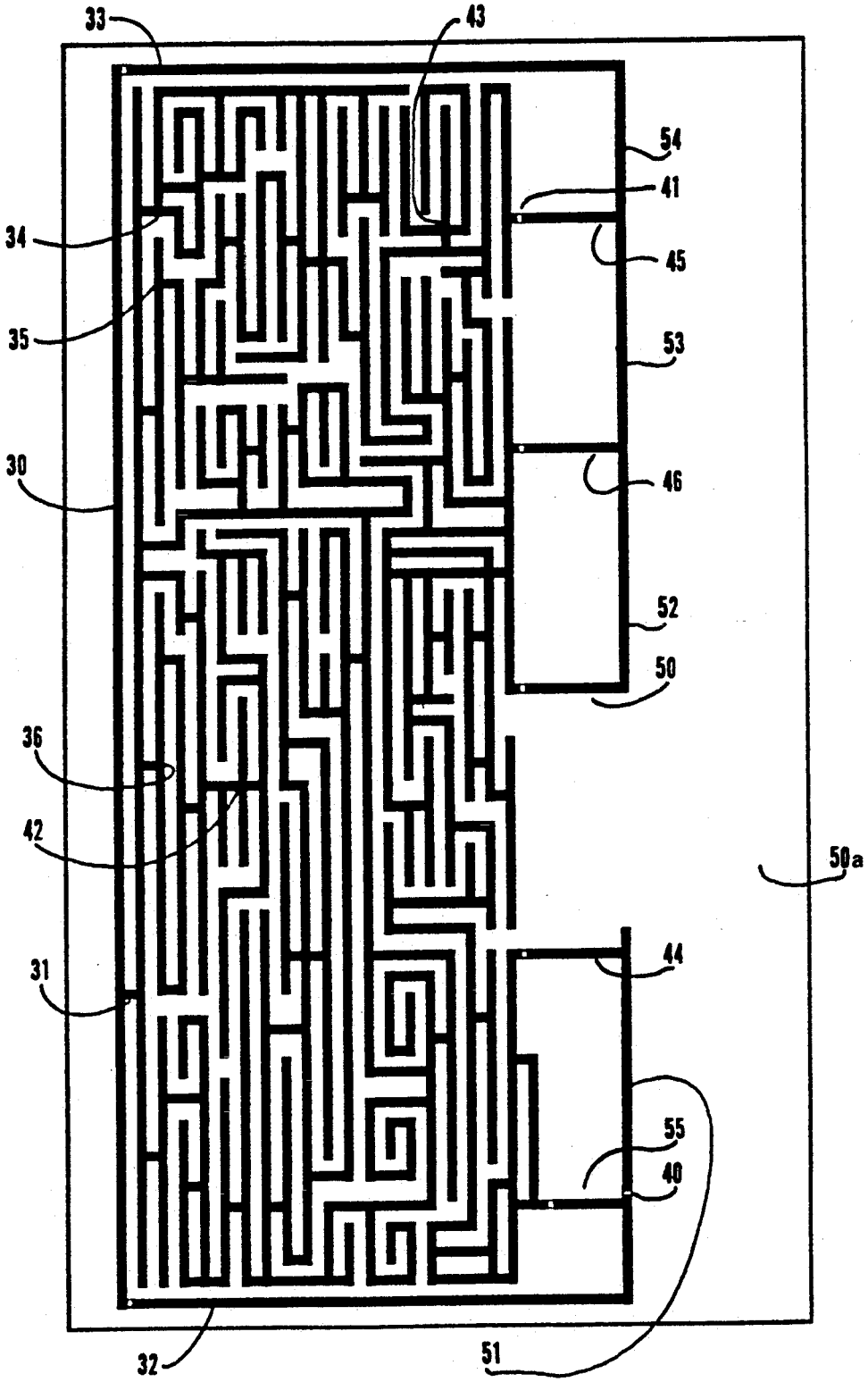
FIG. 7 is a layout diagram of the preferred maze pattern for use in this invention.
Figure 8C:
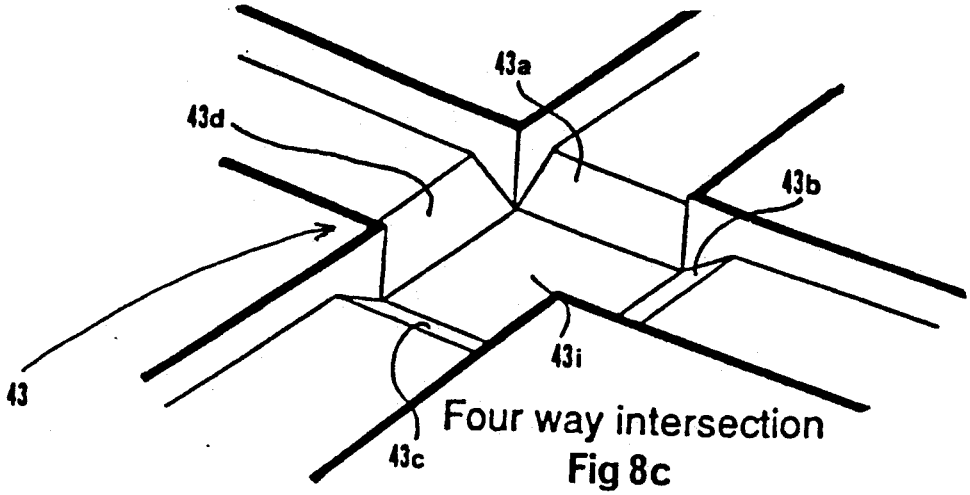
FIG. 8*a*, 8*b* and 8*c* are perspective views of three track details.
Figure 8B:
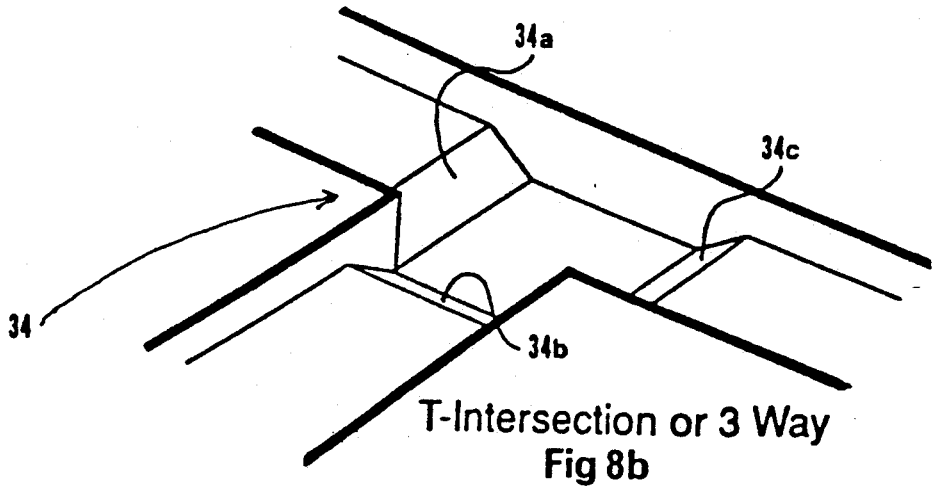
Figure 8A:
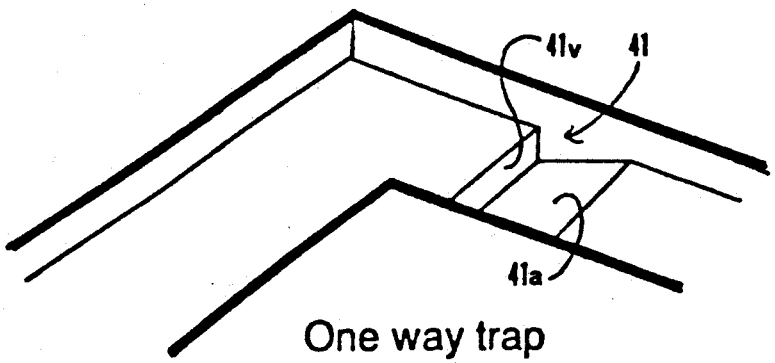
Figure 9:
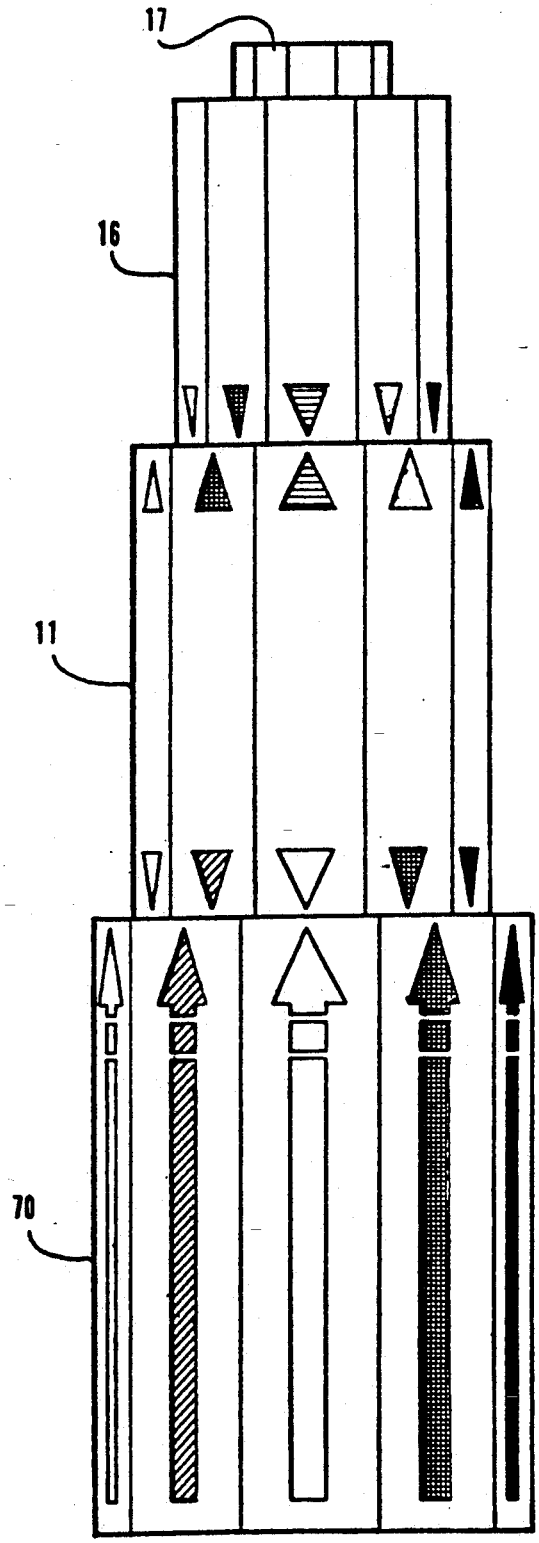
FIG. 9 is a perspective view of an alternate embodiment of this invention providing pyramided mazes and illustrating a correct solution of all mazes.

The preferred maze pattern which is present on the inner wall of the body 11 is illustrated in FIG. 7. Characteristic of this maze pattern is an inner track 30 having only one outlet path 31 and one or more return paths 32 and 33. The maze pattern includes a large number of paths which have the following characteristics:

a) a plurality of T intersections between lateral and longitudinally extending track sections such as 34, 35 and 36;
b) one or more one way traps 40 or 41 of FIG. 7 as best illustrated in FIG. 8*a;*
c) one or more cross-intersections such as 42 or 43;
d) one correct outer path, 44;
e) one or more incorrect outer paths such as 45, 46, 50 and 55;
f) a return path 51 from the correct outer path 44 to the start path;
g) a return path such as 52, 53 or 54 from each incorrect path including a one way trap polarized for return travel only; and
h) increasing numbers of intersection choices as the operator progresses from start to finish.

The construction of this invention as illustrated in FIGS. 4 and 5 also allows additional versatility for the user and ease of manufacture. Referring specifically to FIG. 4, the maze pattern may be seen as located on the inner wall of the cylinder 11 but as a separate member, 50*a*, in the form of a sheet which has molded or milled therein the maze pattern. It is flexible, being formed of plastic material such as polypropylene or polyethylene and flexed to fit in the recess in the inner wall of body 11. It is held in place by the undercut 11*u* and by the bottom plate 11*b*. The latter may be secured to the body 11 by cement for permanent construction or by threaded engagement where interchangability of the maze 50 is desired. The latter allows the maze to be replaced if the maze pattern becomes worn through extreme use or to substitute a different and usually more difficult pattern. Thus the maze puzzle of this invention has extended life and the capability of progressive difficulty, if desired. Also the pin 21 may be replaced if it becomes worn. This is unlikely as compared with conventional mazes since the pin 21 is not required to be in contact with the sidewalls of the maze. Usually, contact of the pin with the side walls signals intersections in other mazes. Here the ramps provide such a signal. Slight wear on the end of the pin 21 does not detract from its operation.

Preferably, there is a signal at each intersection in the form of a button or recess which gives a tactile or sound indication as the bottom of the pin 21 reaches the intersection. This allows a decision to be made at each intersection without the need for the pin to ride against any sidewall of the maze and produce sidewall wear. Likewise, the signal at each intersection alerts the player of an immediate direction decision to be made regardless of any sidewall contact as in conventional maze puzzles.

The various forms of intersections employed in the maze puzzle of this invention are illustrated in FIGS. 8*a–c*. They include a cross intersection shown in FIG. 8*c* such as the four way intersection 43 of FIG. 7. If the pin 21 of FIGS. 4 and 5 enters the intersection 43, there is a tactual indication as the pin 21 drops down the inclined ramp 43*a* to the intersection bottom 43*i*. The operator 16 may next be moved to allow the pin 21 to climb any of the three additional ramps 43*b–d* for continued travel. The pin 21 may also retrace its route by climbing ramp 43*a* again and retracing its step if the user concludes that such is the correct action. The user is signalled tactually as the pin reaches and leaves the intersection 43.

The T or three way intersection of FIG. 8*b* illustrates the intersection 34 of FIG. 7. It differs from the intersection 43 only in that there are a total of three rather than four paths and three rather than four tactual indications of the intersection presence in the form of ramps *a–c*.

FIG. 8*a* illustrates a one way trap 41 which may be located at any place in the maze to allow the pin 21 to travel in one direction only. It is trapped from return travel by the vertical wall 41*v* while allowing travel only in the direction of the arrow of FIG. 8*a* upon entering the trap 41 and riding up the ramp 41*a*. The passage by a one way trap such as 41 can be recognized by the snapping movement of the pin 21 and the inability to travel in a return direction. These are all tactual indications since the maze pattern is concealed at all times.

This combination of maze characteristics provides:

a) a puzzle which has a totally concealed maze,
b) visual and tactile indications of decision points,
c) mandatory return to start upon an incorrect solution.

A further refinement of this invention is illustrated in FIG. in which a series of nested cylinders 11, 16 and 70 with the largest cylinder 70 has the largest maze area. Cylinders 11 and 16 may be identical to those parts having the same reference numerals as in FIGS. 1–6 with the exception that the lower edge of cylinder 11 now includes a spring loaded pin (unshown) like operator 16. The pin of cylinder 11 engages the grooves of its mating recess and maze pattern of part 70. Similar recesses, maze grooves and tracking pin make up the largest maze stage 70. The recess in the cylinder 70 is not shown in the drawing but preferably of greater area and therefore the capability of greater difficulty than the maze of FIG. 5. Difficulty is increased by the larger number of tracks and intersections. A correct solution of the maze of cylinder 70 in addition to that of body 11 provides two stacked or pyramided maze puzzles, an impressive accomplishment.

The puzzle can stand, solved, on its base or may be returned to its nested position for the next player.

Each of the embodiments described above employ a cylindrical maze with movement by the operator in a circular and an axial direction during the solution. The maze is concealed on the inner wall of a recess. The same principle may be applied on a planar form with one member movable in a transverse and longitudinal direction.

The above described embodiments of the present invention are merely descriptive of its principles and are not to be considered limiting. The scope of the present invention instead shall be determined from the scope of the following claims including their equivalents.

What is claimed is:

1. A maze puzzle comprising:

a body member including a maze pattern in the form of interconnected grooves extending between a first or starting position and a final correct position with a multitude of intermediate paths there between but only one final path to the correct final position;

an operator member which conceals said maze pattern at all times;

means carried by said operator for engaging the bottom surface of said maze pattern grooves for defining relative movement between said operator and said body; and said maze pattern including a number of intersections having a discontinuity in the bottom surface of said grooves acting as a tactile signal to a user holding the operator as said engaging means passes through such intersections whereby the user receives a tactile indication of the presence of the intersection and signalling for the user a decision point for possible change of direction.

2. A maze puzzle in accordance with claim 1 wherein said discontinuity constitutes a depression in the bottom of the groove.

3. A maze puzzle in accordance with claim 1 wherein said engaging means comprises a pin carried by said operator.

4. A maze puzzle in accordance with claim 1 wherein said discontinuity constitutes a vertical wall in the bottom of said groove followed by a tapered recessed ramp in the region of the intersection whereby the engaging means slides off the vertical wall without warning and preventing return movement and the tapered ramp allows the engaging means to move forward.

5. A maze puzzle in accordance with claim 1 wherein said body includes a generally cylindrical recess and said operator comprises a mating cylindrical section:

said maze pattern being located on the cylindrical wall of said cylindrical recess; and said engaging means being located on the exterior side wall of the cylindrical section of said operator and including means for biasing said engaging means into engagement with said maze pattern.

6. A maze puzzle in accordance with claim 1 wherein said grooves include at least one unidirectional discontinuity which allows relative movement of said engaging means in one direction in said groove only.

7. A maze puzzle in accordance with claim 1 wherein said body and operator each include indicia thereon and wherein said indicia match and are identifiable only at the correct end position of the maze puzzle.

8. A maze puzzle in accordance with claim 1 wherein said maze pattern is located upon a separable liner for said body whereby said pattern is interchangeable.

9. A maze puzzle in accordance with claim 1 including a second maze pattern located in a cylindrical recess in said operator extending outward from said recess in said body; and a second operator telescoping into said first operator including second engaging means secured to said second operator for engaging said second maze pattern whereby said maze puzzle includes two separate maze puzzles.

10. A maze puzzle in accordance with claim 1 wherein said unidirectional discontinuity comprises a substantially vertical wall in the bottom of a groove at one end of the discontinuity and a ramp at the other end thereof.

11. A maze puzzle in accordance with claim 1 wherein said body and operator each include indicia on the exterior wall thereof and wherein said indicia are identifiable and match only at the correct end position of the maze puzzle.

12. A maze puzzle in accordance with claim 1 wherein the indicia on said operator are concealed within said body until the final position.

13. A maze puzzle in accordance with claim 1 wherein the number of intersections available increases as the operator progresses from start to finish.

* * * * *